United States Patent [19]

Vollmer et al.

[11] Patent Number: 4,683,454

[45] Date of Patent: Jul. 28, 1987

[54] SOLENOID ACTUATOR WITH ELECTRICAL CONNECTION MODULES

[75] Inventors: David J. Vollmer, Ironia; James E. Greame, Long Valley, both of N.J.

[73] Assignee: Automatic Switch Company, Florham Park, N.J.

[21] Appl. No.: 793,208

[22] Filed: Oct. 31, 1985

[51] Int. Cl.[4] ..... H01F 15/10; H01F 27/04

[52] U.S. Cl. ..... 335/299; 336/96; 336/107; 336/192; 251/129.15; 439/364; 439/365; 335/255

[58] Field of Search ..... 339/147 R, 154 A; 251/129.01, 129.15; 336/107, 96, 192; 335/255, 299

[56] References Cited

U.S. PATENT DOCUMENTS

| | | | |
|---|---|---|---|
| 2,418,531 | 4/1947 | Tognola | 336/96 X |
| 3,588,039 | 6/1971 | Chelminski et al. | 251/129.15 |
| 3,688,244 | 8/1972 | Savoca et al. | 339/154 A X |
| 4,215,326 | 7/1980 | Hollyday | 339/147 R X |
| 4,423,841 | 1/1984 | Palma | 251/129.15 X |
| 4,540,154 | 9/1985 | Kollhinsky et al. | 251/129.15 |
| 4,572,600 | 2/1986 | Nieman | 339/147 R X |

*Primary Examiner*—Arnold Rosenthal
*Attorney, Agent, or Firm*—Alan H. Levine

[57] ABSTRACT

A solenoid actuator including a coil of electrically conductive wire, a yoke of magnetic material surrounding the coil, and a non-electrically and non-magnetically conductive material encapsulating the coil and yoke. A pair of terminals connected to the ends of the coil project outwardly beyond an exterior surface of the encapsulation. Any of a variety of electrical connection modules is adapted to receive the coil terminals and electrically connect them to standard electrical connectors projecting from the module. Different modules have different forms of standard electrical connectors, so that regardless of the type of connector available at the source of electric power, a suitable module can be connected to the encapsulated coil for cooperation with the power source connector. The body of each module is formed of resilient material so that when the module is tightly attached to the coil encapsulation, a seal is formed completely surrounding the coil terminals. Particular modules may incorporate rectifiers, time delay circuits, power-enhancing circuits, and radio controlled switches.

14 Claims, 2 Drawing Figures

SOLENOID ACTUATOR WITH ELECTRICAL CONNECTION MODULES

Figure 1:
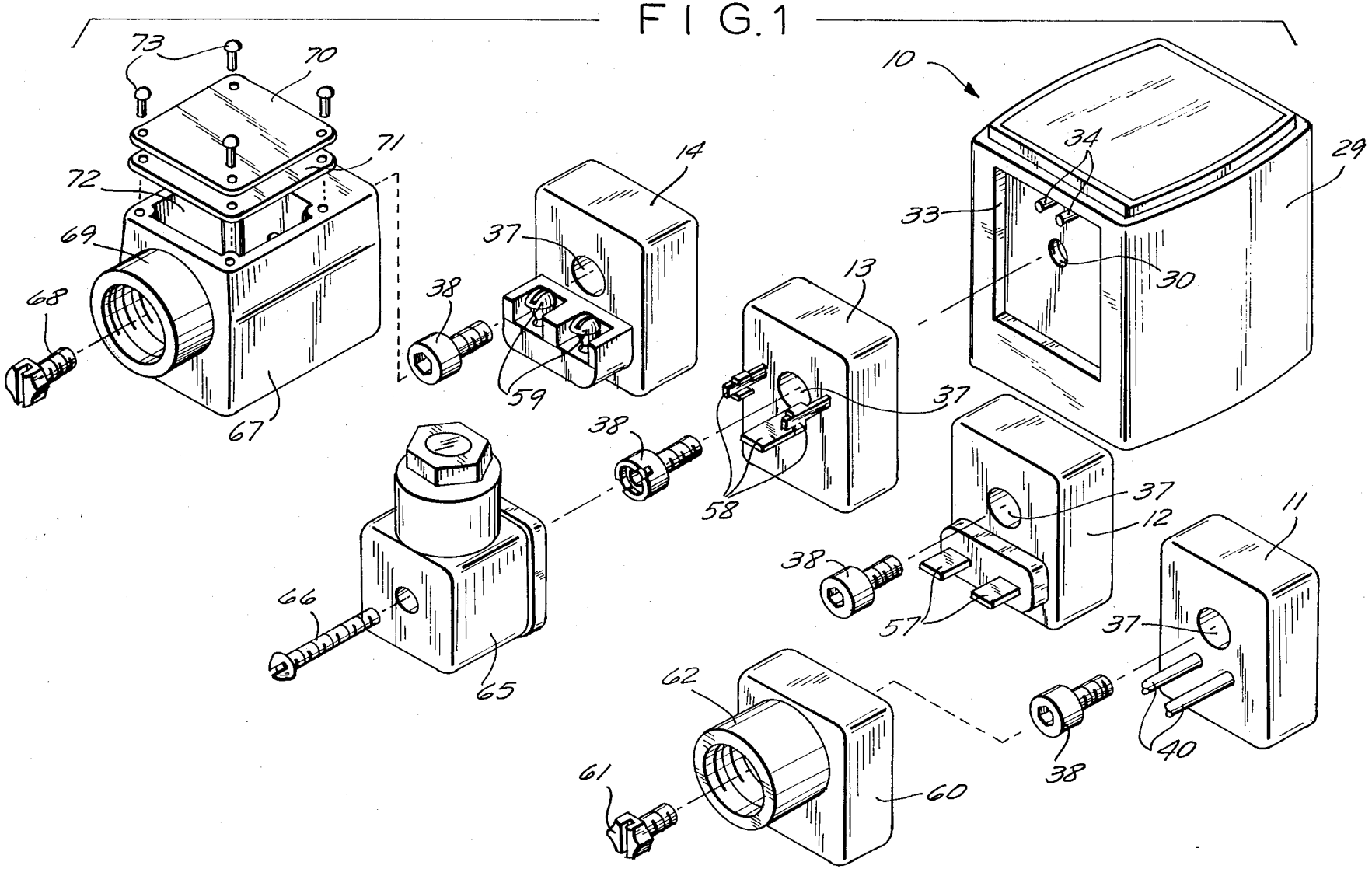

This invention relates to solenoid actuators which are used to operate a wide variety of devices in response to electrical signals. For example, solenoid actuators are commonly used to open and close valves which control the flow of fluids.

Typically, a solenoid actuator includes a coil of electric wire, a steel yoke surrounding the coil to define a magnetic circuit, and a plastic encapsulation around the yoke and coil. Both ends of the wire coil project through the encapsulation and are available for connection to a source of electric power for energizing the coil. This connection is usually made by splicing the two coil ends to wires which are connectable to the source of power. Therefore, should the solenoid coil fail for any reason, it is necessary to unsplice the ends of that coil from the power-carrying wires and then resplice the ends of a new solenoid coil to those wires.

It is an object of the present invention to provide a solenoid actuator, the coil of which can be disconnected from the conductors which carry power to the solenoid and replaced by a fresh solenoid, without the need for unsplicing and resplicing wires.

It is another object of the present invention to provide a solenoid actuator wherein the coil is connected to a source of power by means of a module which "plugs into" the encapsulated coil.

It is a further object of the invention to provide such a solenoid actuator wherein different modules are available having different forms of standard electrical connectors for connecting the modules to a source of electric power.

It is an additional object of the invention to provide such a solenoid actuator wherein each module body is formed of a resilient material, so that upon being pressed tightly against the solenoid coil encapsulation the module body provides a seal completely surrounding the coil terminals, to keep those terminals free of rain, water, and dust.

It is still another object of the invention to provide such a solenoid actuator in which the modules contain circuit elements for providing features such as rectification of AC power to DC power, time delay for delaying operation of the solenoid actuator, power enhancement for stepping-up the voltage initially applied to the solenoid coil, and radio-controlled switching for permitting the actuator to be operated by a radio signal from a remote source.

Additional objects and features of the present invention will be apparent from the following description, in which reference is made to the accompanying drawings.

Figure 2:
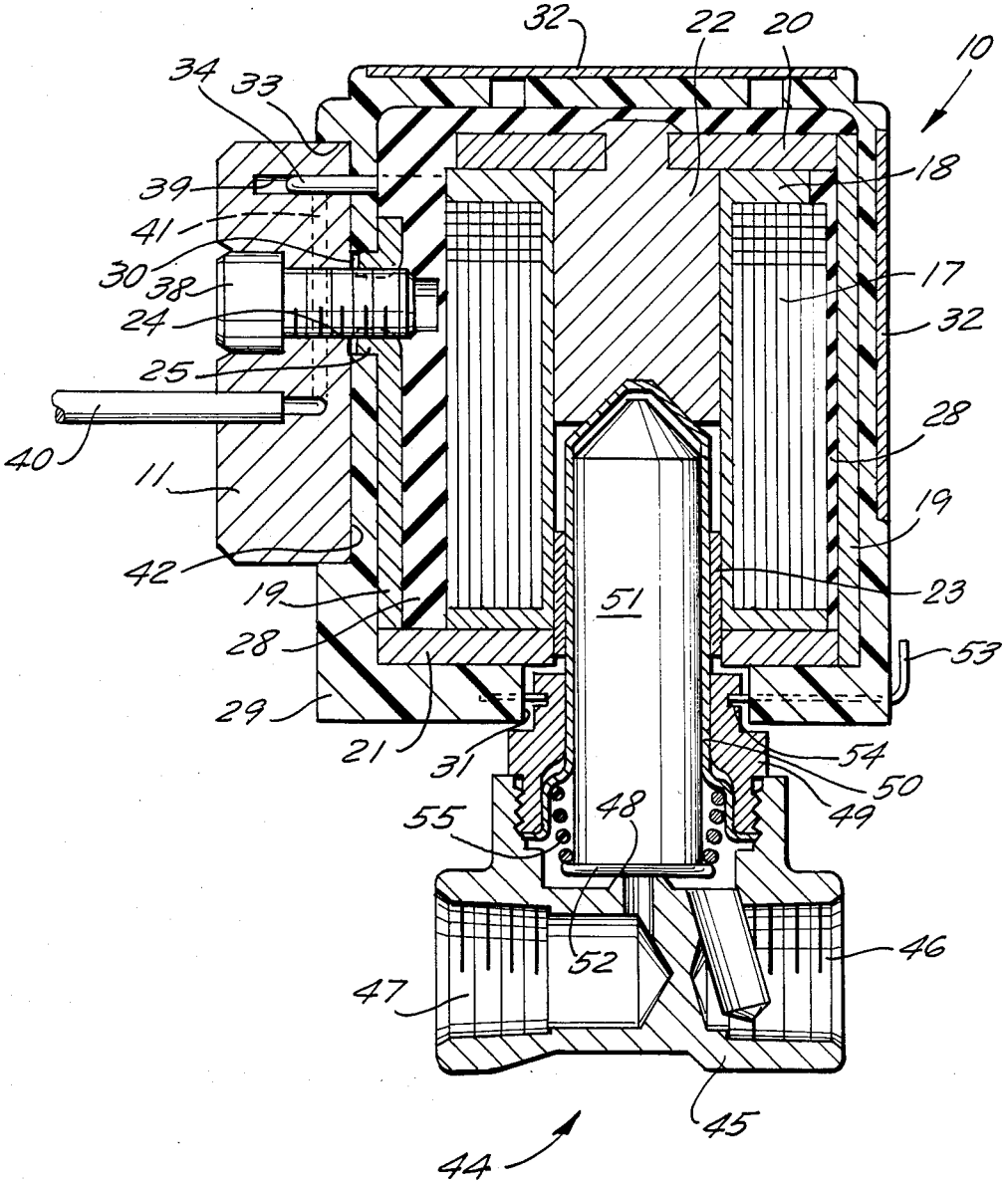

In the drawings:

FIG. 1 is an exploded perspective view showing an encapsulated coil and yoke as well as a variety of electrical connection modules cooperable with the encapsulated coil and yoke; and FIG. 2 is a cross-sectional view of a solenoid actuator, according to the present invention, used to operate a valve.

A solenoid actuator chosen to illustrate the present invention includes an encapsulated coil and yoke 10 (FIG. 1) cooperable with any of a variety of electrical connection modules 11, 12, 13, and 14.

As shown in FIG. 2, the encapsulated element 10 includes a coil 17 of electrically conductive wire wound upon a spool 18 of non-electrically and non-magnetically conductive material. Surrounding the coil and spool is a yoke of magnetic material, such as steel, including a side wall 19 extending around the entire periphery of coil 17, a top wall 20, and a bottom wall 21. A stationary armature 22, carried by top wall 20, extends into, and partially fills, the interior of spool 18. A tubular sleeve 23, carried by bottom wall 21, also extends into the interior of spool 18. At one point, side wall 19 of the yoke is formed with an outwardly projecting boss 25 surrounding an internally threaded hole 24.

Between side wall 19 of the yoke and the external surface of coil 17 is an inner encapsulation 28, formed of a suitable plastic material. Almost completely surrounding the yoke and coil is an outer encapsulation 29 also formed of a suitable plastic material. The only openings in encapsulation 29 are a hole 30 (see also FIG. 1) aligned with threaded hole 24, and a hole 31, coaxial with the axis of spool 18, for providing access to the interior of spool 18 through sleeve 23.

On its top and rear faces, outer encapsulation 29 is formed with shallow recesses for accommodating plates or labels 32 which bear information about the characteristics of the solenoid, and perhaps a trademark and the trade name of the manufacturer. On its front face, encapsulation 29 is formed with a deeper depression 33 (see also FIG. 1) shaped to accommodate part of the depth of one of the modules 11–14. In the present example, depression 33 has a rectangular shape as does each of the modules. Projecting through encapsulation 29, within depression 33, are a pair of pins 34 serving as terminals for coil 17, each pin 34 being connected to one end of coil 17.

Each of the modules 11–14 is formed with a through hole 37 so located that when the module is fitted into depression 33, hole 37 is aligned with hole 30. In FIG. 2, module 11 is shown assembled within depression 33. The module is fastened to encapsulated element 10 by means of a threaded bolt 38 which passes through holes 37 and 30, and is threaded into hole 24 in yoke wall 19. The inner face of module 11, and all the other modules as well, is formed with two holes 39 (only one being shown in FIG. 2) for tightly accommodating coil terminals 34. Extending outwardly from the front wall of module 11 are a pair of wire leads 40 adapted to be connected, such as by splicing, to wires which can bring electric power to leads 40. Within module 11, a pair of conductors 41 (only one being shown in FIG. 2) electrically connect each wire lead 40 to one of the holes 39, and hence to one of the terminals 34.

Thus, when module 11 is "plugged into" depression 33, terminals 34 enter holes 39 and become electrically connected to leads 40, respectively. The body of module 11, and that of each of the other modules, is sized to fit very snugly within depression 33. Furthermore, each module body is formed of a tough but resilient material, such as a suitable plastic, so that when bolt 38 is rotated sufficiently to tightly compress rear wall 42 of the module against the inner wall of depression 33, the material of the module body forms a tight seal around terminals 34. In this way, rain, water, and dust are prevented from reaching those terminals, thereby insuring continued good electrical contact between the terminals and the conductors 41.

The solenoid actuator according to this invention may be used to operate a wide variety of devices. An example of such devices is the valve 44 shown in FIG. 2. Valve 44 includes a valve body 45 having a fluid inlet port 46, a fluid outlet port 47, and a valve seat 48 between those ports. A bonnet 49 is threaded into the valve body, the bonnet carrying a non-magnetic core tube 50. Slidable within core tube 50 is a movable armature 51 formed of magnetic material, the lower end of armature 51 carrying a valve element 52 of resilient material adapted to cooperate with valve seat 48.

The solenoid actuator is assembled with the valve by sliding core tube 50 through sleeve 23 until the end of the core tube engages stationary armature 22, as shown in FIG. 2. A spring clip 53, slidable within encapsulation 29, is then moved to engage an annular slot 54 in bonnet 49 so as to hold the solenoid actuator and valve together. In FIG. 2, coil 17 is deenergized, and hence a spring 55 holds valve disk 52 against valve seat 48 to close the valve. When coil 17 is energized, armature 51 rises within core tube 50, to close the gap shown between the top of armature 51 and the top wall of core tube 50, thereby lifting valve disk 52 off valve seat 48 to open the valve.

Each of the modules 11–14 carries on its front face a different type of standard electrical connector. As described above, module 11 carries wire leads 40. Module 12 carries two spade terminals 57. Module 13 carries a three-pronged terminal 58 of the type usually called a "DIN conector". Module 14 carries a pair of screw terminals 59; these terminals are used by wrapping the end of a wire conductor around the shaft of the screw, and then tightening the screw so as to grip the wire between the head of the screw and the surface into which the screw is threaded. Obviously, other types of standard connectors can be provided on similar modules.

In each case, the terminals of modules 12, 13, and 14 are electrically connected inside the module body to the holes 39 in the rear face of the module which accommodate terminals 34. In this way, the electrical connectors 57, 58, and 59 are electrically connected to the coil terminals 34. A threaded bolt 38 is furnished with each module 12, 13, and 14 for securing the module to the encapsulated coil and yoke 10.

Standard electrical fittings of various kinds can be used with the modules 11–14. For example, if wires from the power source are to be run through a conduit, a conduit connector 60 can be employed. Connector 60 can be attached to one of the modules by means of a screw 61 passing through a hole in conduit connector 60 and into a threaded hole provided in the head of bolt 38. Connector 60 has an internally threaded collar 62 by means of which connector 60 can be secured to the end of a length of conduit.

A so-called "Hirschmann connector" 65 can be employed with module 13, this connector having female slots (not shown) for accepting prongs 58. Here again, a screw 66 can be used to secure connector 65 to module 13, assuming an appropriate threaded hole is provided in the head of bolt 38. Also, a standard junction box 67 can be employed with one or another of the modules. This box can be connected to the module by a screw 68 threaded into a hole in the head of bolt 38. The junction box carries an internally threaded collar 69 for attachment to the end of a length of conduit. The junction box also has a cover 70 and gasket 71 for closing the opening 72 in the box, the cover and gasket being held in place by screws 73. By removing cover 70, access to the wiring within box 67 is available.

If desired, modules 11–14 can be used which contain circuit elements for providing certain desired functions. For example, the module employed can include a rectifier where it is desired to energize coil 17 only with DC power. In this way, even if the only power available is of the AC type, the coil can still be operated by DC power. In addition, a module can contain a time delay circuit, so as to introduce a delay between the time power reaches the module and the time that coil 17 is energized. Furthermore, the module may incorporate a circuit for providing a temporary surge of power to the coil 17 when the coil is initially energized. In some situations, more power is needed to initiate an action controlled by the solenoid actuator then is needed to maintain the condition of the device being controlled. Moreover, the module may contain a radio-controlled switch, so that power available at the module is not provided to coil 17 until a radio signal is received which closes the switch. Obviously, other types of circuits can also be included within a module.

It will be appreciated that the solenoid actuator of the present invention offers a number of advantages. If, during use, coil 17 should burn out or fail in some other way, it is only necessary to unplug the module from the coil, disconnect the encapsulated coil from the device which it controls (such as by manipulating spring clip 53 to disconnect the encapsulated coil from the valve), and plug the module into a new encapsulated coil. No splicing or other type of time-consuming electrical connection need be made. Furthermore, only a single stock of encapsulated solenoids 10 need be maintained, since these elements can be used with any of the variety of electrical connection modules provided. In other words, regardless of the type of electrical connection which will be used to supply power to the solenoid, only a single encapsulated solenoid coil need be used, along with the appropriate module. Thus, the inventory of replacement solenoid coils can be greatly reduced.

Other advantages of the invention are present when a module incorporating a circuit, such as described above, is employed. It is usual to mount such circuit elements adjacent to the solenoid coil, and even encapsulate them with the coil. The circuit elements are thereby subjected to the heat generated by the coil when the latter is energized, which is deliterious to them, especially if they are of the solid state type. By placing these circuit elements in the modules, they are removed from the heat of the coil. In addition, in the conventional arrangement of coil and circuit, should the circuit fail, the entire combination of coil and circuit must be replaced. In the arrangement of the present invention, should a circuit fail, only the module need be replaced, and not the coil. It may be mentioned that all the circuits mentioned above, namely, the rectifier, time delay, power enhancement, and radio-controlled switch, are all well known and hence have not been illustrated or described in detail.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A solenoid actuator comprising:

a coil of electrically conductive wire, a yoke of magnetic material surrounding the coil, a non-electrically and non-magnetically conductive material encapsulating the coil and yoke, a pair of terminals connected to the ends of the coil and projecting outwardly beyond an exterior surface of the encapsulation, an electrical connection module having means for receiving the coil terminals, means for connecting the module to a source of electric power, and means within the module for electrically connecting the coil terminals to the electric power connecting means, and means for fastening the module to the encapsulated coil and yoke, the fastening means including attachment means carried by the yoke, and a fastener cooperable with the attachment means for securing the module to module to the yoke, the encapsulating material having an opening for permitting access to the attachment means.

2. A solenoid actuator as defined in claim 1 wherein the attachment means includes an internally threaded hole, the fastener is a threaded bolt, and the module has a through hole for accomodating the bolt when the latter is threaded into the hole in the yolk.

3. A solenoid actuator as defined in claim 1 wherein the means for connecting the module to a source of electric power includes a pair of wire leads.

4. A solenoid actuator as defined in cliam 1 wherein the means for connecting the module to a source of electric power includes a pair of spade terminals.

5. A solenoid actuator as defined in claim 1 wherein the means for connecting the module to a source of electric power includes a three prong connector.

6. A solenoid actuator as defined in claim 1 wherein the means for connecting the module to a source of electric power includes a pair of screws around which electric wires can be wrapped, the screws having heads beneath which the wrapped wires can be gripped.

7. A solenoid actuator as defined in claim 1 wherein the module contains means for providing a time delay between the time electric current is received by the means connecting the module to a source of electric power and the time the electric current is provided to the coil terminals.

8. A solenoid actuator as defined in claim 1 wherein the module contains means for initially and temporarily increasing the power of the electric current received by the means connecting the module to a source of electric power, whereby increased power is applied to the solenoid coil during its initial period of energization.

9. A solenoid actuator as defined in claim 1 wherein the module contains a radio controlled switch for controlling the energization of the solenoid coil.

10. A solenoid actuator comprising:

a coil of electrically conductive wire, a yoke of magnetic material surrounding the coil, a non-electrically and non-magnetically conductive material encapsulating the coil and yoke, a pair of terminals connected to the ends of the coil and projecting outwardly beyond an exterior surface of the encapsulation, an electrical connection module having means for receiving the coil terminals, means for connecting the module to a source of electric power, and means within the module for electrically connecting the coil terminals to the electric power connecting means, means for fastening the module to the encapsulated coil and yoke, and an enclosure adapted to be mounted adjacent to the module for enclosing the means connecting the module to a source of electric power, the enclosure including means for connection to a length of conduit, whereby electric wires can be extended through the conduit and enclosure and into engagement with the electric power connecting means of the module.

11. A solenoid actuator as defined in claim 10 wherein the enclosure has an opening for providing access to its interior, and a removable cover over that opening.

12. A solenoid actuator comprising:

a coil of electrically conductive wire, a yoke of magnetic material surrounding the coil, a non-electrically and non-magnetically conductive material encapsulating the coil and yoke, a pair of terminals connected to the ends of the coil and projecting outwardly beyond an exterior surface of the encapsulation, an electrical connection module having means for receiving the coil terminals, means for connecting the module to a source of electric power, and means within the module for electrically connecting the coil terminals to the electric power connecting means, and means for fastening the module to the encapsulated coil and yoke, the body of the module being formed of a resilient material, and the means for receiving the coil terminals being spaced inwardly from the periphery of the module, so that when the module is fastened to the encapsulated coil and yoke, it can be compressed against the surface of the encapsulation material and thereby form a seal completely surrounding the coil terminals.

13. A solenoid actuator comprising:

a coil of electrically conductive wire, a yoke of magnetic material surrounding the coil, a non-electrically and non-magnetically conductive material encapsulating the coil and yoke, the exterior surface of the encapsulation material being formed with a depression, a pair of terminals connected to the ends to the coil and projecting outwardly beyond an exterior surface of the encapsulation, an electrical connection module having means for receiving the coil terminals, means for connecting the module to a source of electric power, and means within the module for electrically connecting the coil terminals to the electric power connecting means, the periphery of the module being so sized and shaped that the module fits snugly within the depression in the encapsulation material, and means for fastening the module to the encapsulated coil and yoke.

14. A solenoid actuator comprising:

a coil of electrically conductive wire, a yoke of magnetic material surrounding the coil, a non-electrically and non-magnetically conductive material encapsulating the coil and yoke, a pair of terminals connected to the ends of the coil and projecting outwardly beyond an exterior surface of the encapsulation, an electrical connection module having means for receiving the coil terminals, means for connecting the module to a source of electric power, and means within the module for electrically connecting the coil terminals to the electric power connecting means, the module containing a rectifier between the means for receiving the coil terminals and the means for connecting the module to a source of electric power, so that AC power applied to the module is converted to DC power for application to the coil, and means for fastening the module to the encapsulated coil and yoke.

* * * * *